US005246822A

United States Patent [19]

Evans et al.

[11] Patent Number: 5,246,822

[45] Date of Patent: Sep. 21, 1993

[54] METHOD OF PHOTOGRAPHIC PROCESSING

[75] Inventors: Gareth B. Evans, Hertfordshire; John R. Fyson, London; Peter D. Marsden, Middx, all of United Kingdom

[73] Assignee: Eastman Kodak Company, Rochester, N.Y.

[21] Appl. No.: 924,088

[22] Filed: Aug. 3, 1992

[30] Foreign Application Priority Data

Aug. 24, 1991 [GB] United Kingdom ..... 9118299

[51] Int. Cl.[5] ..... G03C 7/40

[52] U.S. Cl. ..... 430/429; 430/372; 430/373; 430/414; 430/428; 430/463

[58] Field of Search ..... 430/372, 373, 414, 428, 430/429, 463, 943

[56] References Cited

U.S. PATENT DOCUMENTS 4,277,556 7/1981 Koboshi et al. ..... 430/393
4,469,780 9/1984 Hirai et al. ..... 461/430

FOREIGN PATENT DOCUMENTS 2736886 3/1978 Fed. Rep. of Germany .
3302741 8/1983 Fed. Rep. of Germany .
2099402 3/1972 France .
017018 2/1977 Japan .
1268126 3/1972 United Kingdom .
1399481 7/1975 United Kingdom .
1403418 8/1975 United Kingdom .
1560572 2/1980 United Kingdom .

OTHER PUBLICATIONS

Research Disclosure, Dec. 1978, Item 17643, published by Kenneth Mason Publications, Ltd., Dudley Annex, 12a North Street, Emsworth, Hants P010 7DQ, U.K.

Research Disclosure, Dec. 1989, Item 308119, published by Kenneth Mason Publications, Ltd., Emsworth, Hants, U.K.

*Primary Examiner*—Hoa Van Le

*Attorney, Agent, or Firm*—Nixon, Hargrave, Devans & Doyle

[57] ABSTRACT

The present invention is directed to a method of processing imagewise exposed photographic color silver halide materials in which, after the dye image is formed, the photographic material is treated with an aqueous stabilizing solution containing iodide ions but no fixing agent.

11 Claims, No Drawings

METHOD OF PHOTOGRAPHIC PROCESSING

This invention relates to the processing of photographic silver halide materials and particularly to the stabilisation thereof.

In a typical photographic colour process, the imagewise exposed photographic silver halide colour material is subjected to colour development to provide both a silver and a dye image, bleaching to remove the unwanted silver image and fixing to remove the unexposed and still light-sensitive silver halide which would otherwise darken under the influence of light. Bleaching and fixing are often combined in a single bleach-fix bath. It is usual to remove the soluble silver complexes formed by the fixer and any residual bleach by passing the material through a wash or stabiliser bath. The stabiliser usually contains components which will increase the life of the dye image.

In the field of black and white photographic materials, stabilisation processing is known in which the developed material is contacted with compounds which complex with the undeveloped silver halide forming a relatively light-stable compound which then remains in the emulsion layer and does not need to be washed out.

It is always desirable to shorten process times and reduce any environmentally unfavourable features of photographic processes and it is to the solution of this problem that the present invention is directed.

According to the present invention there is provided a method of processing an imagewise exposed photographic colour silver halide material in which, after the dye image is formed the photographic material is treated with an aqueous stabilising solution containing iodide ions but no fixing agent.

The treatment with iodide ions may be preceded by a wash or stop bath treatment, or as an alternative, the iodide ions may be incorporated in either the wash or stop bath solutions.

The advantages of the present invention include a shortening of the process, elimination of certain baths and chemicals normally considered essential and thus saving cost and lessening the effects of the process on the environment.

With silver halide materials containing substantial amounts of silver halide, for example films and papers designed for conventional processing, the present process may not provide processed image-bearing materials with stability over long periods of time. However in some applications this is tolerable. An example of such applications are press photography where a print or film negative is used to get the image into a newspaper and then discarded.

Another example would be a situation where the image is only required long enough for data to be collected, e.g. by scanning, so that once the image is stored in electronic form the photographic dye image could be discarded.

Iodides are non-toxic, inexpensive and readily available. The amount of iodide to be contained in the stabilising solution will depend on the application but will, in general, be within the range from 0.01 to 100, preferably from 0.5 to 10 g/liter iodide ions.

A number of different applications of the present invention can be contemplated. In one embodiment the colour material after image formation, is bleached and partially fixed before the iodide stabilisation step. Such a process would save on fixer time or fixer components.

In a variation of this process, the image-bearing material may be bleached and then directly treated with the iodide solution thus saving fixer entirely.

In another embodiment the iodide ions may be incorporated in the optional stop bath or wash solutions thus combining the entire tail-end processing to a single solution.

The colour photographic material to be processed may be films or paper of any type. Possible total silver halide coverages may range from 1 to 10000 or from 10 to 5000 mg/m$^2$, possibly from 10 to 1000 mg/m$^2$ for conventional materials while preferred silver halide coverages for low silver applications are in the range 1 to 200, preferably 1 to 20 mg/m$^2$ (all coverage figures as silver). The material may comprise the emulsions, sensitisers, couplers, supports, layers, additives, etc. described in Research Disclosure, December 1978, Item 17643, published by Kenneth Mason Publications Ltd, Dudley Annex, 12a North Street, Emsworth, Hants P010 7DQ, U.K.

One aspect of the present invention is concerned with colour redox amplification processes. Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image. The developer-amplifier solution contains a reducing agent, for example a colour developing agent, and an oxidising agent which will oxidise the colour developing agent in the presence of the silver image which acts as a catalyst. The photographic material used in such a process may be a conventional coupler-containing silver halide material or an image transfer material containing redox dye releasers. Oxidised colour developer reacts with a colour coupler (usually contained in the photographic material photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide and compounds which provide hydrogen peroxide, e.g. addition compounds of hydrogen peroxide; cobalt (III) complexes including cobalt hexammine complexes; and periodates. Mixtures of such compounds can also be used. A particular application of this technology is in the processing of silver chloride colour paper, especially such paper with low silver levels.

When the process is used on a very low silver coating weight material, no bleach step is necessary and the density of the silver image can usually be ignored.

The fully processed materials produced by the present invention tend to have a yellow colour associated with the iodide treatment (silver iodide is yellow). This may be objectionable even with low silver materials but this is not always the case. The human brain is known to accommodate even quite serious colour balance errors very quickly. In addition where the material is on a transparent support and intended for viewing by transmitted light, again even quite pronounced minimum densities can be tolerated without any problem. Clearly the less the original silver coating weight, the less will be the yellow colour formed on treatment with iodide ions.

Should the yellow cast be objectionable in a particular application, it can be compensated by the presence of a fluorescent agent either coated with the photographic material or introduced during processing.

The photographic materials can be single colour materials or multicolour materials. Multicolour materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolour photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

In one embodiment of the present invention the material to be processed is photographic paper material preferably comprising at least 80% silver chloride, more preferably at least 90% and particularly, substantially pure silver chloride. The total coating weight of silver halide is preferably from 1 to 200 mg/m$^2$, especially from 1 to 20 mg/m$^2$ (as silver).

The photographic materials to be processed and the processing solutions used may contain any of the components, additives, etc described in Research Disclosure Item 308119, December 1989 published by Kenneth Mason Publications, Emsworth, Hants, United Kingdom.

The following Examples are included for a better understanding of the invention.

EXAMPLE 1

A developer-amplifier was made up of the following formulation:

| | |
|---|---|
| Potassium carbonate | 25.0 g |
| 1-hydroxyethylidene-1,1'-diphosphonic acid | 0.6 g |
| Diethylhydroxylamine | 5.0 g |
| Potassium chloride | 0.35 g |
| 4-N-ethyl-N-(b-methanesulphonamidoethyl)-o-toluidine sesquisulphate | 3.5 g |
| Hydrogen peroxide 30% | 5.0 g |
| Water to | 1 liter |
| pH adjusted to 10.3 with sodium hydroxide solution | |

A colour photographic silver chloride paper was used containing a total amount of silver of 140 mg/m$^2$. The coupler dispersions and emulsions were the same as used in Ektacolor (Trade Mark) 2001 paper except with reduced silver laydown. A piece of this paper was processed, for 45 seconds, in the above developer, without being exposed. The paper was then plunged into a 5% acetic acid solution to prevent further development. The paper was then split into three pieces. One piece was washed in flowing clean tap water for 5 mins. The other pieces were treated with 1 and 5 g/l potassium iodide solutions for 30 seconds and then washed for 5 mins. The strips were then hung up to dry in subdued light.

The processed strips were put in a high intensity fading device, which essentially meant placing the strips two inches away from a daylight flourescent bulb. The strips were held in position for two hours and then the neutral reflection density was measured. The strips were put back in their fading position for a further 16 hours and then the densities were read again. The results for the changes in neutral density (ND) are shown below. They clearly show that those strips that had been treated with the iodide solution had been stabilised against printout.

| Treatment | 2 hr ND change | 18 hr ND change |
|---|---|---|
| None | 0.11 | 0.12 |
| 1 g/l KI | 0.02 | 0.04 |
| 5 g/l KI | 0.00 | 0.01 |

EXAMPLE 2

The procedure of Example 1 was repeated except that the photographic colour paper contained a total of 55 mg/m$^2$ silver halide (as silver) and the developer-amplifier contained 10 of the hydrogen peroxide solution. The results were as follows:

| Treatment | 2 hr ND change | 18 hr ND change |
|---|---|---|
| None | 0.02 | 0.02 |
| 1 g/l KI | 0.00 | 0.01 |
| 5 g/l KI | 0.00 | 0.00 |

Even better results than in Example 1 were obtained.

We claim:

1. A method of processing an imagewise exposed photographic colour silver halide material in which, after the dye image is formed, the photographic material is treated with an aqueous stabilising solution containing iodide ions but no fixing agent.

2. A method as claimed in claim 1 in which the stablising solution contains from 0.01 to 100 gm/liter of iodide ions.

3. A method as claimed in claim 1 in which the stablising solution contains from 0.5 to 10 gm/liter of iodide ions.

4. A method as claimed in claim 1 in which the image-forming step is followed by bleach and partial fix steps before treatment with the iodide solution.

5. A method as claimed in claims 1 in which the image-forming step is followed by a bleach step before treatment with the iodide solution.

6. A method as claimed in claim 1 in which the iodide ions are contained in a stop bath.

7. A method as claimed in claim 1 in which the dye image is produced by a redox amplification process.

8. A method as claimed in claim 7 in which the redox amplification process employs a silver halide colour developing agent and hydrogen peroxide or a compound which provides hydrogen peroxide.

9. A method as claimed in claim 1 in which the photographic material to be processed comprises substantially pure silver chloride emulsions.

10. A method as claimed in claim 7 in which the photographic material to be processed contains from 1 to 200 mg/m$^2$ of silver halide (as silver).

11. A method according to claim 10, wherein said photographic material to be processed contains from 1 to 20 mg/m of silver halide.

* * * * *